US006445897B2

(12) United States Patent
Uezono et al.

(10) Patent No.: US 6,445,897 B2
(45) Date of Patent: Sep. 3, 2002

(54) WET-TYPE DEVELOPING APPARATUS AND IMAGE FORMING APPARATUS USING THE SAME

(75) Inventors: Tsutomu Uezono, Tokyo; Jyun Koyatsu; Ryouichi Yasuda, both of Niigata; Tomoyuki Yoshii, Tokyo, all of (JP)

(73) Assignee: NEC Corporation, Tokyo (JP)

( * ) Notice: Subject to any disclaimer, the term of this patent is extended or adjusted under 35 U.S.C. 154(b) by 0 days.

(21) Appl. No.: 09/783,607

(22) Filed: Feb. 15, 2001

(30) Foreign Application Priority Data

Feb. 18, 2000 (JP) ..... 2000-041501

(51) Int. Cl.[7] ..... G03G 15/10
(52) U.S. Cl. ..... 399/237; 399/239; 399/249
(58) Field of Search ..... 399/237, 239, 399/240, 249

(56) References Cited

U.S. PATENT DOCUMENTS

| | | | | |
|---|---|---|---|---|
| 3,957,016 A | | 5/1976 | Yamada et al. | |
| 5,650,253 A | | 7/1997 | Baker et al. | |
| 5,666,615 A | * | 9/1997 | Nguyen | 399/240 |
| 5,698,616 A | | 12/1997 | Baker et al. | |

FOREIGN PATENT DOCUMENTS

| | | |
|---|---|---|
| JP | 48-79644 | 10/1973 |
| JP | 4-503265 | 6/1992 |
| JP | 7-301997 | 11/1995 |
| JP | 8-123207 | 5/1996 |
| JP | 8-292610 | * 11/1996 |
| JP | 10-73997 | 3/1998 |
| JP | 11-73025 | 3/1999 |
| JP | 2915031 | 4/1999 |
| JP | 2990675 | 10/1999 |

* cited by examiner

*Primary Examiner*—Quana M. Grainger
(74) *Attorney, Agent, or Firm*—McGinn&Gibb, PLLC

(57) ABSTRACT

In a wet-type developing apparatus in which a latent image carrying member and a squeeze roller are moved in the opposite directions to each other while they are not brought into contact with each other at the closest position thereof, a liquid toner layer on the latent image carrying member which is smaller in thickness than the gap interval between the latent image carrying member and the squeeze roller is made to invade into the gap, and the liquid toner invading into the gap between the squeeze roller and the latent image carrying member are brought into contact with the squeeze roller by electrical attractive force based on electric field formed between the squeeze roller and the latent image carrying member, thereby forming meniscus.

9 Claims, 6 Drawing Sheets

WET-TYPE DEVELOPING APPARATUS AND IMAGE FORMING APPARATUS USING THE SAME

BACKGROUND OF THE INVENTION

1. Field of the Invention

The present invention relates to a wet-type developing apparatus for use in an electrostatic recording type or electrophotographic type image forming apparatus such as a printer, a facsimile machine, a copying machine or the like, and an image forming apparatus using the same.

2. Description of the Related Art

In a wet-type developing process of developing an electrostatic latent image on a latent image carrying member with liquid toner containing carrier liquid and toner particles dispersed in the carrier liquid, there has been hitherto adopted such a method that in order to efficiently exclude surplus solvent (carrier liquid) on a developed image area and a liquid toner layer on a non-image area, a squeeze roller is moved with being brought into contact with the latent image carrying member or keeping a predetermined gap interval (distance) between the squeeze roller and the latent image carrying member.

For example, in the case of an apparatus described in Japanese Laid-open Patent Application No. Sho-48-79644, a squeeze roller and a photosensitive drum are moved in the same direction while the squeeze roller is pressed to the photosensitive drum, and the same polarity potential as toner is applied thereto to: prevent offset. Further, in the case of an apparatus described in a Japanese Registered Patent No. 2915031, a liquid toner layer having a thickness of several hundreds $\mu$m is made to invade into the gap of about 50 $\mu$m between a squeeze roller and a photoreceptor medium, variation of the viscosity of liquid toner being used is detected, and the revolution number of the squeeze roller is controlled in accordance with the revolution number. In this case, no bias voltage is applied to the squeeze roller.

Further, in the case of an apparatus described in Japanese Laid-open Patent Application No. Hei-8-179633, carrier liquid is squeezed in a squeeze gap which is narrower than the developing gap, and a gap which is larger than the squeeze gap is provided between a photosensitive drum and an electric field forming roller in the next step. When the toner layer passed through the above gap, the toner particles are cohered by discharge current occurring in the gap between the electric field forming roller and. the toner layer. In this case, the electric field forming roller is confronted to the toner layer so that the carrier liquid is surely prevented from getting contact with the electric forming roller. Therefore, no shearing stress is applied to a toner image, and thus an image having no toner dispersion can be achieved.

In this case, it is particularly necessary to keep a sufficient gap so that the toner image is prevented from coming into contact with the electric field forming roller due to attraction of the toner image to the electric field forming roller. Further, at the squeeze roller side of the front stage, the gap is narrower than the thickness of the developed toner layer, and shearing stress to exclude the surplus carrier liquid is applied. That is, the exclusion of the liquid and the cohesion of the toner particles are performed by two rollers.

As another case, the specification of U.S. Pat. No. 3,957,016 discloses that the intermediate potential between an image portion potential and a non-image portion potential is applied to a regulating roller to clean the base portion, and the image portion is slightly compressed.

Further, according to Japanese Published Patent No. Hei-4-503265, in order to remove liquid on a-non-image portion after the development and reduce the thickness of the liquid, a squeeze roller is provided and the value of bias to be applied to the squeeze roller is set to the intermediate potential between the non-image portion potential and the image portion potential. Further, a toner hardening roller to which a voltage is applied is confronted at the downstream side of the squeeze roller while the liquid toner is interposed on the latent image carrying surface between the transfer position and the toner hardening roller. The toner hardening roller is designed so that the liquid is not substantially removed from the tone image, and the toner image is afterwards transferred onto a transfer medium by electric field.

According to a method described in Japanese Laid-open Patent Application No. Hei-7-301997, a squeeze roller is moved in the opposite direction to a latent image carrying member, and the liquid adhesion amount on the surface of the squeeze roller before the squeeze roller comes into contact with the liquid toner layer after development is set to 0.1 $\mu$m (micrometer) or less, whereby the thickness of the toner layer after squeezed is reduced and a toner layer suitable for the transfer step is achieved. No provision is given to the velocity ratio of the squeeze roller and the electric field at the squeeze portion. In any case, the parts are fabricated under the condition that the liquid is interposed between the squeeze gap. That is, the construction is designed so that liquid is interposed between the gap even when no external electric field exists at the squeeze portion.

Japanese Laid-open Patent Application No. Hei-10-73997 discloses the following system. Representing the image portion potential by V1, representing the non-image portion potential by V2, representing the developing bias by Vdr and representing the squeeze roller bias by Vrr, the following inequality is set: $Vrr > V2 \geqq Vdr$ for $V1 > V2$, and also the following inequality is set: $Vdr \geqq V2 > Vrr$ for $V1 < V2$. According to this system, toner is attached to the non-image portion by the development, but it is withdrawn from the non-image portion by the squeeze roller.

In the above-described prior arts, the liquid toner image is generally transferred onto a transfer medium such as paper or the like by electrophoresis. The above-described prior arts describe only the case where the thickness of the toner layer which is formed on the latent image carrying member and contains the liquid carrier after the development is larger than the gap between the squeeze roller and the latent image carrying member, or pay no attention to the thickness of the toner layer.

That is, the above-described prior arts adopts such a design that a large amount of surplus liquid toner layer adheres to both of the image portion area and the non-image portion area on the latent image carrying member and thus most of the surplus liquid toner layer is first excluded at the nip entrance port of the squeeze roller and latent image carrying member. This design is equivalent to such a design that the thickness of liquid is reduced. Accordingly, in the conventional methods, even toner particles which should originally adhere to the image portion flow out from the surface of the latent image carrying member, and thus a finally formed image is usually short of the image density. Further, since excessive shearing stress is applied to the liquid toner layer in even the gap, toner dispersion sometimes occur at the leading end or trailing end of the toner image. Still further, even when consideration is given not to apply strong shearing stress, the compression of the carrier liquid in the liquid toner layer adhering to the image portion is insufficient, and thus the solid content (component) rate of the toner layer cannot be increased. This causes the toner image to be squeezed and flow out in the next transfer step. Further, this causes such a disadvantage that the drying time in the fixing step is long. Further, there is such a disadvantage that the transfer based on the pressure using;no electrostatic electric field and the adhesive force cannot be executed as a transfer method.

As a method of forming a color image may be considered a method of squeezing a first color toner image, to achieve a sufficient solid content rate on the latent image carrying member, subsequently electrifying the overall surface on the latent image carrying member on which the first color toner layer is carried out, and executing a series of steps of performing light exposure, development and squeezing for a second color toner image to superpose two color toner images on the latent image carrying member. If the same steps until the squeezing step as described above are executed for plural other color toner images on the latent image carrying member, a full color image can be formed on the latent image carrying member. Accordingly, there can be achieved a process of collectively transferring two or more color toner images on an intermediate transfer medium or a recording medium such as paper of the like.

However, in the above-described prior art, a sufficient solid content rate cannot be achieved after the squeezing. Therefore, when the prior art are used to form a color image, it is impossible to form a latent image or color mixing occurs, and thus there is a disadvantage that two or more color toner images cannot be superposed on the latent image carrying member before the transfer step.

Further, since the toner layer developed on the latent image carrying member is electrically charged, there is observed such a phenomenon that the mirror image charge based on the charge of the toner layer itself is formed at the squeeze roller side, and toner is offset to the squeeze roller due to the electric force between the charge of the toner layer itself and the mirror image charge. This phenomenon is mainly caused by the fact that at the squeezing portion, an external electric field, that is, an offset-preventing potential difference is not provided between the latent image carrying member board and the squeeze roller conducting portion, or the value of the offset-preventing potential difference is improper even when the offset-preventing potential difference is provided. Particularly when the potential setting is carried out as described in Japanese Laid-open Patent Application No. Hei-10-73997, a large amount of toner adheres to the squeeze roller side, and a cleaning work for the toner is more cumbersome. Further, since the toner is withdrawn from the image portion to the squeeze roller, an image thus formed is short of image density. In addition, a squeeze offset phenomenon is liable to occur.

SUMMARY OF THE INVENTION

An object of the present invention is to provide a wet-type developing apparatus which can simultaneously perform sticking and cohesion of toner particles developed in an image portion area on a latent image carrying member, removal of surplus carrier liquid and removal of a liquid toner layer adhering to a non-image portion area, and also can achieve an image having sufficient image density with no occurrence of toner dispersion and flow-out of toner, and an image forming apparatus using the wet-type developing apparatus.

Further, another object is to provide an image forming apparatus which can form multi-color images on a latent image carrying member and collectively transfer these multi-color images, and other object is to provide a wet-type developing apparatus and an image forming apparatus in which no offset phenomenon to a squeeze roller occurs.

In order to attain the above objects, according to the present invention, a wet-type developing apparatus In which a latent image carrying member and a squeeze member (such as a squeeze roller and a squeeze belt) are moved in the opposite directions to each other without coming into contact with each other and a liquid toner layer on the latent image carrying member is squeezed between the latent image carrying member and the squeeze member, comprises means for forming a liquid toner layer on the latent image carrying member so that the liquid toner layer has a thickness smaller than the gap between the latent image carrying medium and the squeeze member; means for making the liquid toner layer invade into the gap together with the latent image carrying member; and means for forming an electric field between the squeeze member and the latent image carrying member, wherein the liquid toner layer invading into the gap between the squeeze member and the latent image carrying member is brought into contact with the squeeze member by the electric attractive force based on the electric field to form a desired meniscus.

In the wet-type developing apparatus thus constructed, the squeezing means for squeezing the surplus carrier liquid of the liquid toner layer adhering to the surface of the latent image carrying member in the developing area is moved in the opposite direction to that of the latent image carrying member. The thickness of the liquid toner layer adhering onto the latent image carrying member is smaller than the gap distance at the closest position between the squeezing means and the latent image carrying member, and it is set to such a value that the liquid toner layer is not brought into contact with the squeezing means when the electric field based on the potential difference between the latent image carrying member board and the conductive layer of the squeezing means is not applied. At this time, by applying the electric field between the squeezing means and the latent image carrying member, the liquid toner layer on the latent image carrying member is brought into contact with the surface of the squeezing means. The surplus carrier liquid is squeezed out by the shearing stress which occurs in the liquid toner layer due to the speed difference between the latent image carrying member and the squeezing means, and the solid content (component) rate of the toner layer on the latent image carrying member passing through the squeezing means can be increased, so that a clear image can be achieved by transferring this toner. Further, in the color image forming process, the toner transfer can be excellently performed without mixing colors in the next developing step for the second and subsequent color toner images.

DETAILED DESCRIPTION OF THE PREFERRED EMBODIMENTS

Preferred embodiments according to the present invention will be described hereunder with reference to the accompanying drawings.

The fundamentals of the present invention have been reached by verifying the situation that even when strong shearing stress is generated in a liquid toner layer under the condition that the liquid toner layer is brought into contact with a squeeze roller, neither toner flow-out nor toner dispersion occurs.

That is, the present invention has been implemented by paying attention to the following matters. That is, if the squeeze gap is set to be smaller than the thickness of the liquid toner layer after the development as in the case of the prior arts, the shearing stress is excessively large and thus the flow-out of toner particles is promoted. Therefore, this setting is unfavorable and it is desirable to form a liquid toner layer thinner than the squeeze gap through the development and make the liquid toner layer thus formed invade into the squeeze gap.

However, if only the above geographical condition is satisfied, the liquid toner layer invading into the squeeze gap is occasionally brought into contact with the squeeze roller because a small amount of liquid toner or carrier liquid which adheres to and remains on the squeeze roller serves as a trigger. Therefore, the contact of the liquid toner layer to the squeeze roller and the formation of meniscus are unstable, so that the carrier liquid removal efficiency is low.

Therefore, if some electric field is formed between the squeeze gap, it has been found that an electrical attractive force which is estimated to be caused by dielectric polarization occurs to bring the liquid toner into contact with the squeeze roller, so that meniscus can be stably formed and the squeeze efficiency is enhanced, and also it has been found that the flow-out of the toner particles is reduced and thus the toner solid content (component) rate can be enhanced. Further, it has been found that there is a shearing stress range which can maximize the solid content rate and the solid content amount, that is, a range of the optimum speed ratio between the squeeze roller and the latent image carrying member.

Figure 1:
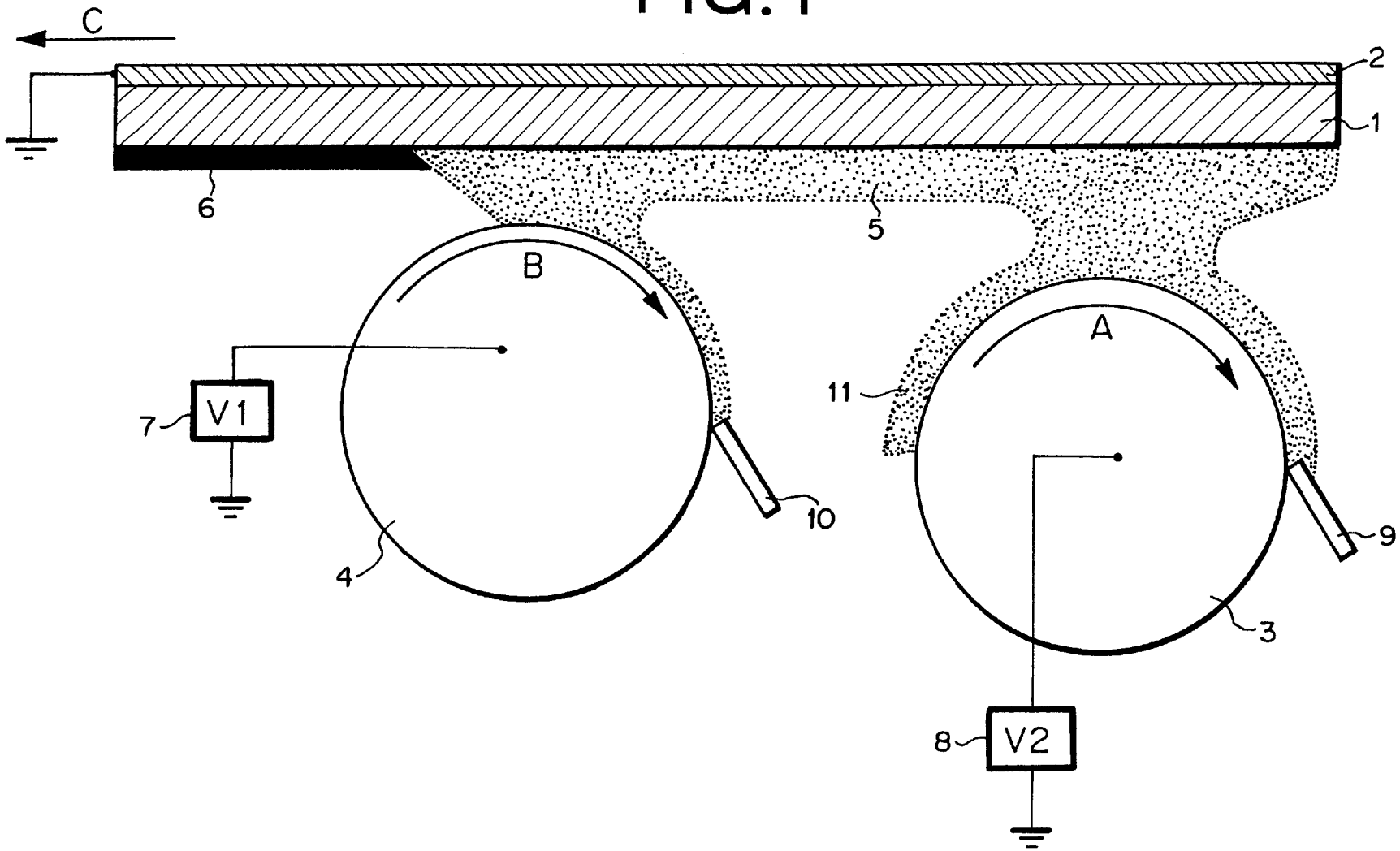
FIG. 1 is a schematically enlarged view showing developing and squeezing parts of a wet-type developing apparatus according to the present invention.

Therefore, in the present invention, latent image carrying member 1 such as a photoconductor (photoreceptor) provided on latent image carrying member board 2 and squeeze roller 4 shown in FIG. 1 are moved in the opposite directions to each other while they are not brought into contact with each other at the closest position thereof, and the liquid toner layer 5 on the surface of the latent image carrying member 1 is squeezed therebetween.

The wet-type developing apparatus includes means for forming a liquid toner layer 5 on the latent image carrying member 1 in advance so that the thickness of the liquid toner layer 5 is smaller than the gap interval between the latent image carrying member 1 and the squeeze roller 4 (in this embodiment, liquid toner 11 is supplied through the surface of developing roller 3, that is, the means is the developing roller 3), means for making the liquid toner layer 5 and the latent image carrying member 1 invade into the gap (in this embodiment, the invasion is caused by the rotation of the developing roller 3 in the direction indicated by an arrow A, the electric field generated by a power source 8 and the movement of the latent image carrying member 1 in the direction indicated by an arrow C, that is, the means is the developing roller 3, the power source 8 and an apparatus for moving the latent image carrying member 1), and means for forming an electric field between the squeeze roller 4 and the latent image carrying member 1 (in this embodiment, the means is power source 7).

The liquid toner layer 5 invading into the gap between the squeeze roller 4 and the latent image carrying member 1 is brought into contact with the squeeze roller 4 by the electrical attractive force based on the electric field generated by the power source 7 to form desired meniscus.

In this case, in this embodiment, the moving speed ratio of the squeeze roller 4 and the latent image carrying member 1 is set to −0.5 to −2.0 (minus 0.5 to minus 2.0). Further, the electric field formed between the squeeze roller 4 and the latent image carrying member 1 is electric field having such direction that in both the image area and the non-image area the liquid toner 5 adheres to the latent image carrying member 1 to perform the development. The polarity of the potential of the squeeze roller 4 is same as that of the non-image area (portion) of the latent image carrying member 1, and the absolute value of the potential of the squeeze roller is larger than that of the non-image area (portion). of the latent image carrying member 1. The liquid toner 5 is formed so that the glass transition point of the toner particles disposed in the carrier liquid thereof is equal to −1° C. (minus 1° C.) or less. In FIG. 1, scraper blades 9 and 10 are formed of polymer material and are provided as counters to the developing roller 3 and the squeeze roller 4, respectively.

In the wet-type developing apparatus of the present invention, after squeezed, the toner layer 6 is transferred from the latent image carrying member 1 to a recording medium or an intermediate transfer medium (not shown) by mechanical pressure or both of mechanical pressure and electric field, thereby keeping, excellent quality as an image forming apparatus.

In this case, it is preferable that the solid content rate of the toner layer 6 at the non-segmented portion (the area estimated to be filled all over with the toner layer) on the latent image carrying member 1 after squeezed is equal to 55 wt % (weight percentage) or more, and a process of performing the electrical charging on the overall surface of the latent image carrying member 1 on which the liquid toner layer 6 after the squeezing is carried, the image exposure, the development and the squeezing is repeated to form two or more color toner images on the latent image carrying member 1, and then the two or more color toner images are collectively transferred onto a transfer medium (not shown) such as a recording medium, an intermediate transfer medium or the like.

With this construction, the squeeze means (squeeze roller 4) for squeezing the surplus carrier liquid of the liquid toner layer adhering to the surface of the latent image carrying member 1 in the developing area is moved in the opposite direction to the moving direction of the latent image carrying member 1. The thickness of the liquid toner layer 5 adhering onto the latent image carrying member 1 is smaller than the gap interval at the closest portion between the squeeze means and the latent image carrying member, and the thickness is set to such a value that when the electric field based on the potential difference between the latent image carrying member board 2 and the conductive layer of the squeeze means is not applied, the liquid toner layer 5 is not brought into contact with the squeezing means.

At that time, by applying the electric field between the squeeze means and the latent image carrying member 1, the liquid toner layer 5 on the latent image carrying member 1 is brought into contact with the surface of the squeezing means. The surplus carrier liquid is squeezed out by the shearing stress occurring in the liquid toner layer 5 due to the speed difference between the latent image carrying member 1 and the squeeze means, and the solid content rate of the toner layer 6 on the latent image carrying member 1 passing through the squeeze means can be increased, so that a clear image can be achieved by transferring this toner. Further, in a color image forming process, the toner transfer can be excellently performed without mixing colors in the developing step for second and subsequent colors.

Next, some embodiments of the present invention will be described.

First Embodiment

As described above, FIG. 1 is an schematically enlarged view showing a developing portion and a squeeze portion of a wet-type developing apparatus according to a first embodiment of the present invention.

In this embodiment, positively charged toner was used as the liquid toner 11, and NORPAR12 (produced by EXXON company) was used as the liquid carrier. The toner concentration was set to 3 wt %, and the viscosity of the liquid toner was equal to 1.5 cps (centipoise). The developing roller 3 was supported so as to keep a gap interval of 300 μm from a photosensitive belt serving as the latent image carrying member 1, and rotated in the direction of the arrow A in FIG. 1. The moving speed of the photosensitive belt was set to 70 mm/sec in the direction of the arrow C, and the moving speed ratio of the latent image carrying member (photosensitive belt) 1 and the developing roller 3 was set to −3 (minus 3).

After the overall surface of the latent image carrying member 1 was electrically charged by a charger (not shown) in advance, it was subjected to image exposure with laser beams. At this time, the potential of the non-image portion was equal to about 700 V, the potential of the image portion was set to about 150 V, and the bias potential of the developing roller was equal to 450 V. An SUS (stainless steel) roller having an outer diameter of 20 mm was used as the developing roller 3.

The liquid toner layer 5 on the non-segmented image area after the development was measured to have a thickness of about 20 μm by using a wet thickness gage (produced by Kumagaya Riki Kogyo Kabushiki Kaisha). Further, the toner solid content rate at that time was equal to about 25%. The solid content rate was calculated by printing a solidly-shaded (black) portion (non-segmented portion) of about 4 cm×4 cm, drying it at 80° C. for one hour and then measuring the weight of the developed toner layer before and after the drying step by using an electronic balance.

Subsequently, the liquid toner layer a having a thickness of about 20 μm thus formed invaded into the site of the squeeze roller 4 in the gap of 100 μm. A predetermined bias voltage was applied to the conductive shaft of the squeeze roller 4, and the electric field is formed by the potential difference between the squeeze roller 4 and the grounded base portion 2 of the latent image carrying member 1. An SUS roller coated with an urethane rubber layer of 20 mm in outer diameter and 1 mm in thickness was used as the squeeze roller 4, and the squeeze roller 4 was rotated in the direction of the arrow B (negative direction). The residual liquid layers,on the developing roller 3 and the squeeze roller 4 were scraped off by the scraper blades 9 and 10. When the squeeze roller 4 was rotated in the opposite direction to the direction of the arrow B, the scraper blade 10 was fixed at the opposite side.

As a result, a slight amount of residual liquid existed on the squeeze roller 4. The thickness thereof was measured to be about several μm by using a laser type film thickness measuring device: LT-8010/8000 produced by KEYENCE CORP.

The experimental results obtained on the basis of the above construction will be described.

Figure 2:
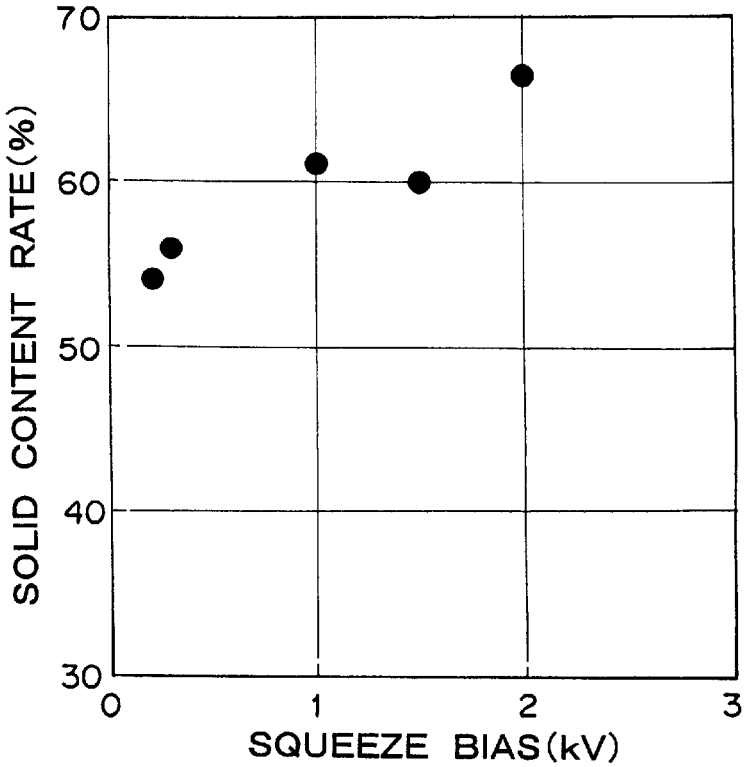
FIG. 2 is a graph showing an experiment result indicating the effect of a voltage applied to a squeezing roller of the wet-type developing apparatus according to a first embodiment of the present invention.

First, the bias value to be applied to the squeeze roller 4 and the solid content rate of the toner layer 6 at the non-segmented image portion after the squeezing have such a tendency as shown in FIG. 2. The squeeze roller 4 was rotated at the speed ratio of −1 (minus 1) and the squeeze gap was set to 100 μm. When the bias value was equal to 1 KV (kilovolt) or more, the solid content rate of the toner layer after the squeezing was equal to 60 to 70% (percent) and this value means a stable and high value. However, when the bias value was less than 1 KV, the solid content rate was small and unstable. Further, when the squeeze roller was set to the ground potential as in the case of the potential of the base portion (board 2) of the latent image carrying member, it was confirmed that the liquid toner layer 5 was brought into no contact with the squeeze roller 4. From these results, under the squeeze bias value which is above 0 V and less than 1 KV, the dielectric polarization amount of the liquid toner layer 5 is small and thus the electrical attractive force is short. However, under the squeeze bias value which is equal to or more than 1 KV, the liquid toner layer 5 is brought into contact with the squeeze roller 4 by the electrostatic attractive force based on the dielectric polarization of the liquid toner layer 5 to form meniscus. Therefore, it is estimated that the shearing stress occurs in the liquid toner layer 5 due to the meniscus thus formed and the difference between the moving speed of the squeeze roller 4 and the moving speed of the latent image carrying member 1, so that surplus carrier liquid having a low toner concentration which seems to exist on the surface of the toner image in the image area portion can be removed. Further, it is also estimated that undesired toner liquid at the non-image portion is removed by the shearing stress.

Figure 3:
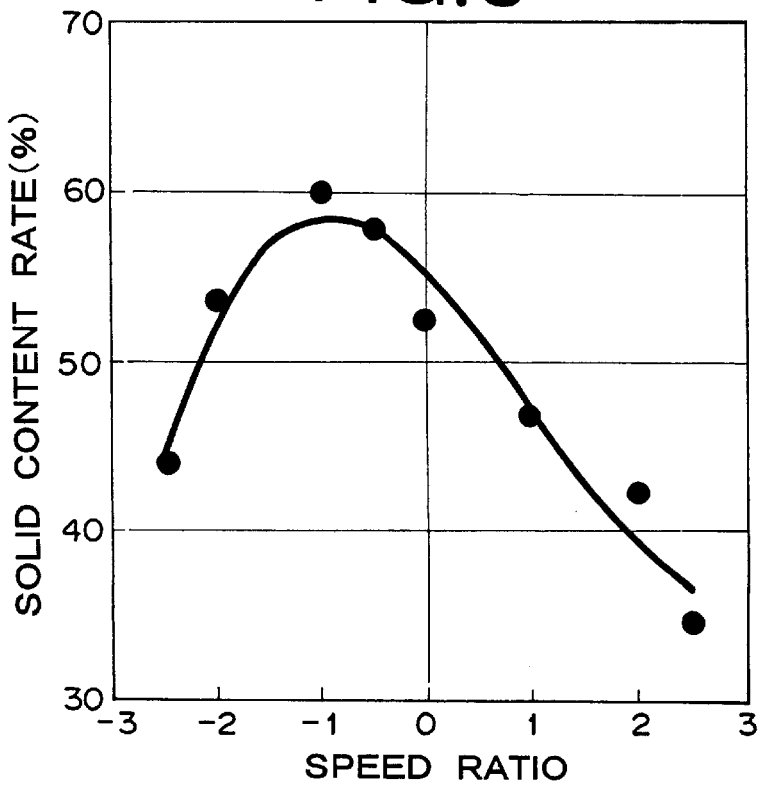
FIG. 3 is a graph showing an experiment result indicating the effect of a squeeze roller speed ratio of the wet-type developing apparatus according to the first embodiment of the present invention.

Next, the results of the effect of the moving speed of the squeeze roller 4 on the solid content rate are shown in FIG. 3.

Figure 4:
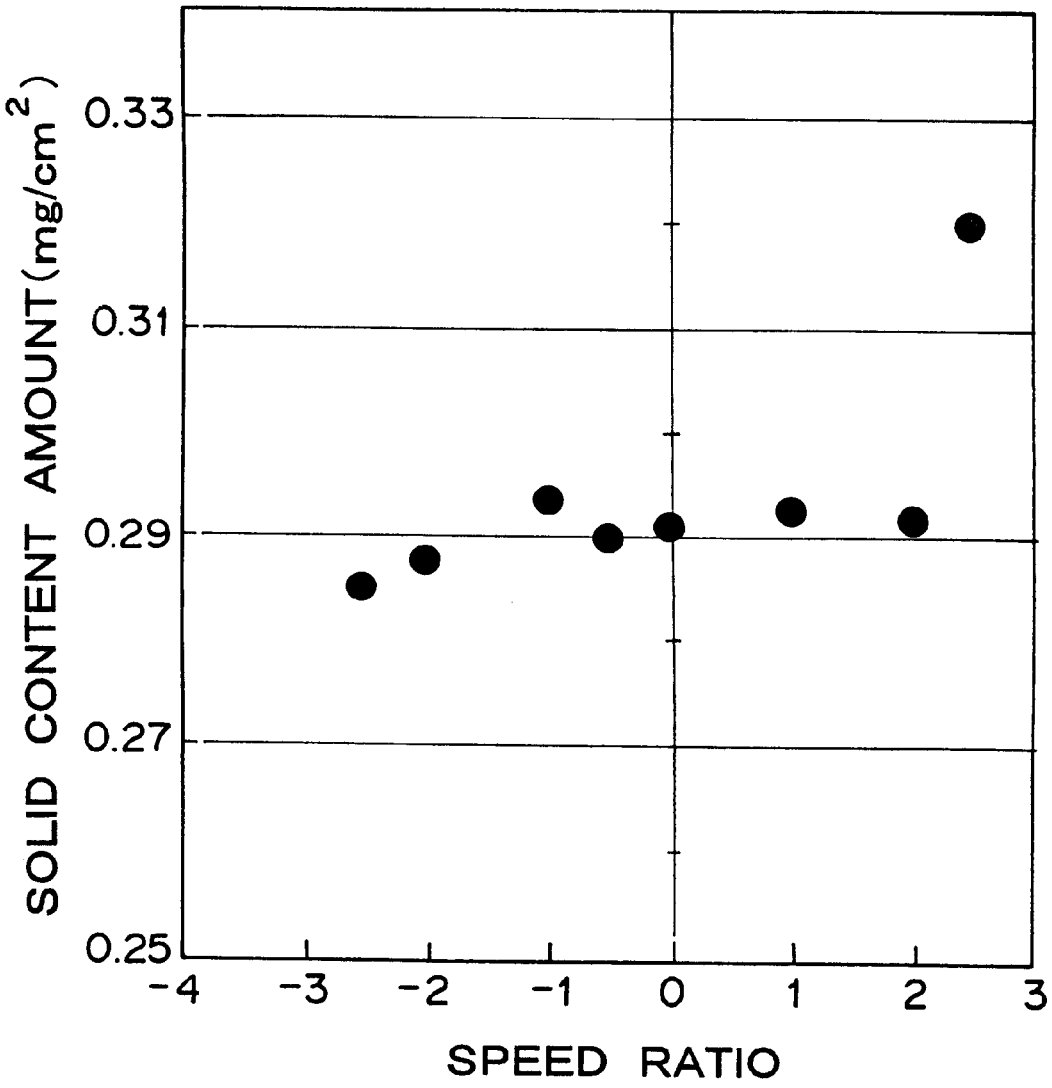
FIG. 4 is a graph showing an experiment result indicating the effect of a squeeze roller speed ratio of the wet-type developing apparatus according to the first embodiment of the present invention.

The experimental conditions were nearly the same as described above. The different point resides in that the bias value of the squeeze roller 4 was fixed to 1 KV and the speed ratio of the squeeze roller 4 was varied. The solid content rate was equal to the maximum value (60%) in the neighborhood of the speed ratio of −1, and thus it was found that the optimum speed ratio existed. The toner solid content amount of the non-segmented portion remaining on the latent image carrying member 1 was equal to about 0.29 mg/cm$^2$ (milligram/square centimeter) as shown in FIG. 4, and substantially fixed. The following considerations may be made from the above results.

The liquid toner layer 5 after the development invades into the predetermined squeeze gap, the dielectric polarization of the liquid carrier occurs due to the electric field, meniscus is formed and the squeezing is started. At this time, the concentration gradient of toner is estimated to be formed in the vertical direction (thickness direction) in the liquid toner layer 5 by the electric field at the developing portion and the electric field at the squeeze portion.

The shear plane is formed in the liquid toner layer 5 due to the speed difference between the latent image carrying member 1 and the squeeze roller 4. The position of the shear plane in the vertical direction is dependent on the speed difference, the viscosity gradient based on the concentration gradient and the wettability between the liquid toner layer 5 and the surface of the latent image carrying member 1 and between the liquid toner layer 5 and the surface of the squeeze roller 4.

Figure 5A:
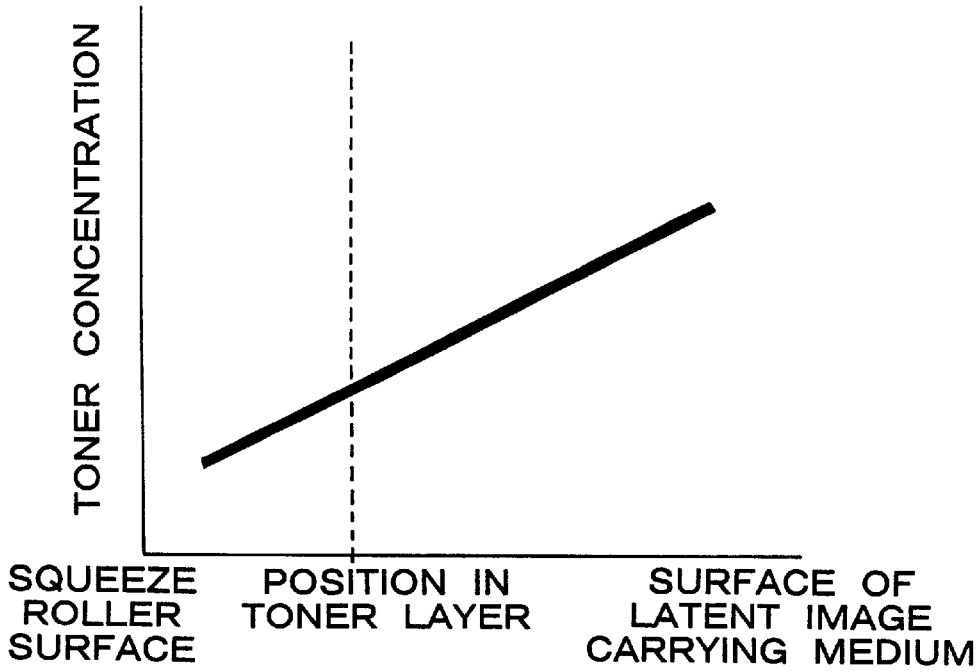
FIGS. 5A and 5B are diagrams showing the concentration gradient of a toner layer at the squeeze roller portion of the wet-type developing apparatus according to the first embodiment of the present invention.
Figure 5B:
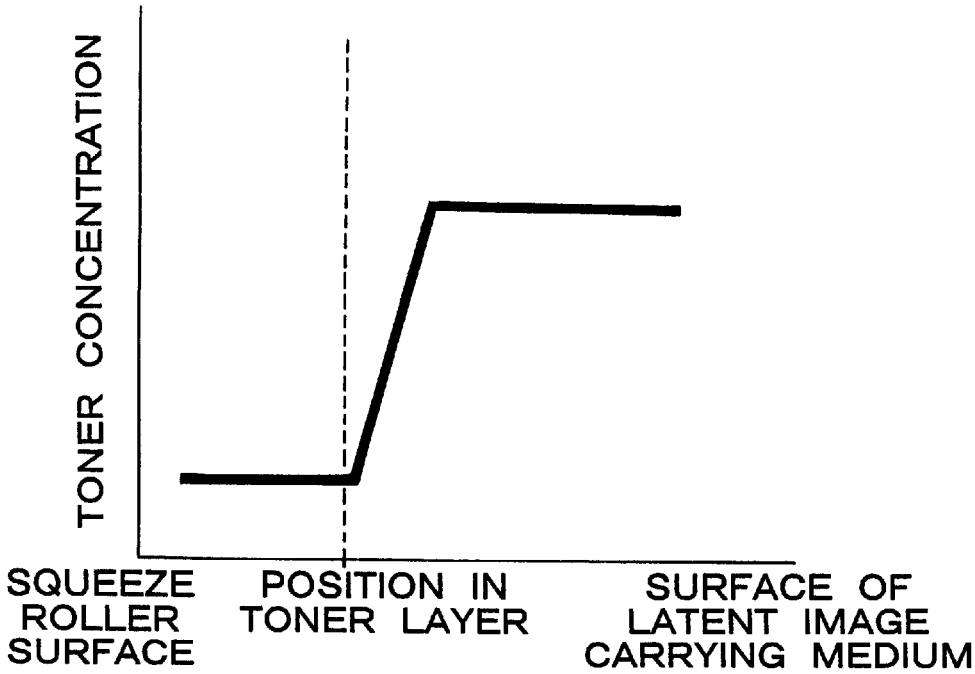

In consideration of the fact that the solid content amount of the toner was substantially fixed irrespective of the rotational speed ratio as shown in FIG. 4, it is estimated that the concentration gradient in the liquid toner layer 5 after the development is not a linear one as shown in FIG. 6A, but one which sharply increases in concentration from some position as shown in FIG. 5B.

In order to achieve a toner layer having a high solid content rate and a high solid content amount, the rotational speed ratio and the electric field is required to be optimized so that the shear plane is located at the position at which the concentration gradient is sharply varied. It is estimated that under the condition of FIG. 3, the optimum range for the rotational speed ratio was from −0.5 to −1.5 and preferably in the neighborhood of −1.

In the liquid toner layer 5 after the development, a layer having a higher toner concentration exists on the surface of the image area of the latent image carrying member 1. However, it is estimated that toner particles are not perfectly cohered/stuck to one another, a liquid layer having a small toner concentration at an initial stage before the development is estimated to exist as a surplus toner layer on the high-concentration layer, and the liquid layer under this state is fed out from the developing gap. As described above, the liquid toner layer 5 which is located at the image area after the development and substantially composed of the two layers (the high-concentration layer and the small concentration layer) had an average toner concentration of 25 wt % as described above. Since this liquid toner layer 5 invades into the squeeze gap in the next stage, the flow-out of toner would occur if excessive shearing stress is applied to the liquid toner layer 5 which has not been completely solidified as described above.

The function of the squeezing is to exclude the surplus toner layer on the high-concentration toner layer and further squeeze out the surplus carrier liquid in the high-concentration toner layer. From the viewpoint of preventing the flow-out of toner, it is indispensable to be cohered and stick the toner particles of the high-concentration toner layer before the squeezing. The electric field force and the pressure (squeezing force) in the squeezing gap are estimated to serve as force to promote the cohesion of the toner particles.

In the prior arts, since the thickness of the toner layer invading into the squeeze gap is larger than the squeeze gap, excessive squeezing force is applied to the toner layer and thus the toner flows out before the toner particles are cohered by the electric field. This means that the much attention has been i paid to the pressure (squeezing force) as the force to be cohered the toner particles in the prior arts.

On the other hand, according to the present invention, the toner cohesion/sticking are substantially performed by only the electric field force. Since the thickness of the liquid toner layer 5 invading into the gap is smaller than the gap interval and the force to excluding the liquid is small, the flow-out of toner particles is hard to occur, and the toner particles are pressed against the latent image and stuck/cohered by the polarization based on the electric field. The surplus carrier liquid containing a large amount of opposite charges to the toner is attracted from the shear plane to the squeeze roller side, and efficiently excluded to the outside of the squeeze nip by the shearing stress. Accordingly, the solid content rate of the toner is enhanced, and the sticking/cohesion of the toner are promoted.

The solid content rate of the toner layer 6 thus formed after the squeezing is stable and a high value exceeding 55 wt %, so that the mutual sticking force of the toner particles is strong and the adhesive force is also high. Accordingly, when the toner image is transferred to a sheet or an intermediate transfer medium by the electric field force in the next transfer step, the excellent transfer operation can be performed with no image missing and no image flowing out. Further, since the sticking force and the adhesive force among the toner particles are sufficiently strong, the transfer of the toner can be performed by pressure. Therefore, as compared with the conventional electrophoresis transfer operation based on the electric field, the transfer speed of toner particles is higher, and thus the printing operation can be performed at higher speed.

Further, the toner layer 6 having the high solid content rate and the strong mutual sticking force/cohesion force among toner particles has the following secondary effect. That is, even when the carrier liquid of another liquid toner layer is brought into contact with the surface of the toner layer concerned, the cohesion of the toner particles of the toner layer concerned is not; disturbed by the toner particles of the other toner layer. Accordingly, images of second and subsequent colors can be formed on the toner layer 6 having the high solid content rate after the squeezing.

Second Embodiment

Figure 6:
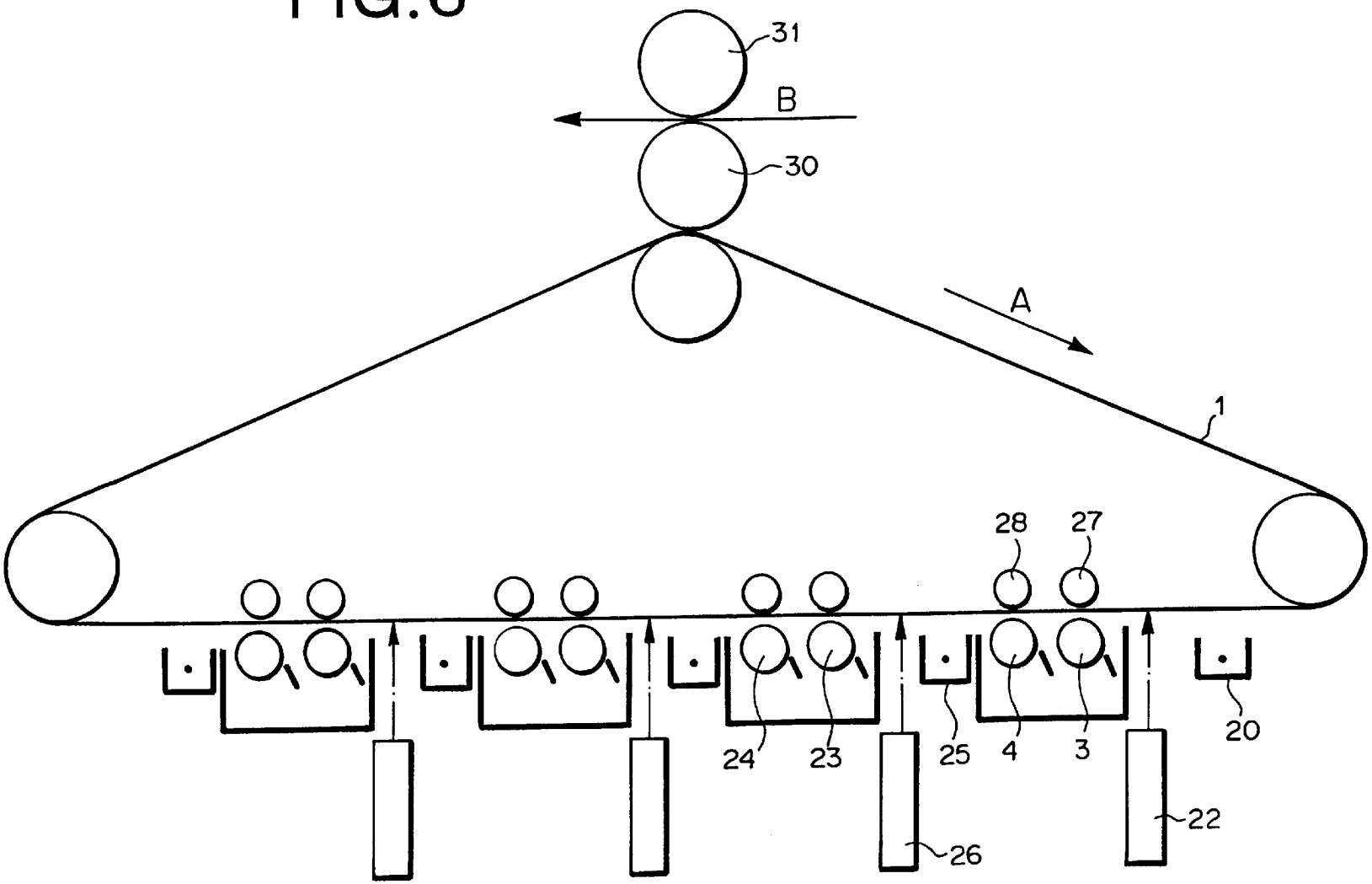
FIG. 6 is a diagram showing a second embodiment in which the wet-type developing apparatus according to the present invention is applied to a multi-color image forming apparatus.

FIG. 6 shows an embodiment of a multi-color image forming apparatus having the wet-type developing apparatus according to the present invention.

In this embodiment, a first color toner image was formed on the latent image carrying member 1 rotating/moving in the direction of an arrow A by charger 20, laser light source 22, developing roller 3 and squeeze roller 4. After the image forming process had been completed until the squeezing step, electrification was carried out on the overall surface containing the surface of the toner layer by second color charger 25, an image exposure for the second color surface was carried out by laser 26, and the development was carried out by using developing roller 23 for the second color. The squeezing operation was carried out by using a squeeze roller 24 for the second color, whereby excellent color superposition could be performed without occurrence of flow-out of toner and color mixing in the image.

That is, a two or more color image could be formed on the latent image carrying member 1. Subsequently, the operation for forming another color image was carried out, and four color toner images were collectively transferred to an intermediate transfer medium (transfer roller) 30 by only the pressure. Subsequentliy the images could be transferred/fixed to a recording medium inserted in the direction of the arrow B by applying pressure with a fixing roller 31 and the transfer roller 30.

In the prior arts, each color image is transferred to an intermediate transfer medium by one color and four color images are completely transferred i to the intermediate transfer medium by rotating the latent image carrying medium at four times, so that registration is degraded. Accordingly, according to the present invention, the registration is also more greatly enhanced by the above process. The transfer efficiency can be more-effectively enhanced by auxiliarily applying electric field in addition to application of pressure when the transfer to the intermediate transfer medium 30 is carried out.

Third Embodiment

Figure 7:
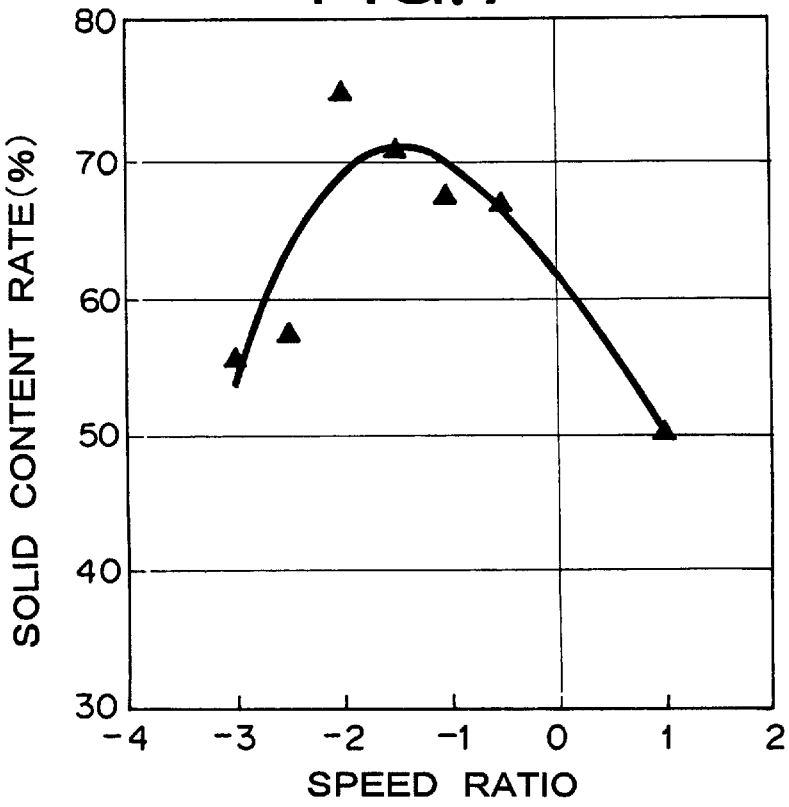
FIG. 7 is a graph showing an experiment result indicating the effect of the squeeze roller speed ratio of a wet-type developing apparatus according to a third embodiment of the present invention.

In a third embodiment of the present invention, the speed ratio of the squeeze roller and the latent image carrying member was varied under the same condition as the first embodiment except that the squeeze gap was set to 75 $\mu$m. The experiment results of this embodiment will be described with reference to FIG. 7. However, the voltage applied to the squeeze roller was set to 1 KV. In this case, like the experiment results of the first embodiment using the gap of 100 $\mu$m, there was such a tendency that the solid content rate was maximum in some range of the speed ratio. However, this range of the speed ratio was around −1 to −2, and the solid content rate value was equal to a high value (about 70%).

Fourth Embodiment

In this embodiment, the squeeze gap was set to 75 $\mu$m as in the case of the third embodiment, and the press force of the cleaning scraper blade for the squeeze roller was set to be less than that of the third embodiment. Therefore, the thickness of the liquid layer remaining on the squeeze roller was larger than that of the third embodiment, and it was equal to about 20 $\mu$m. The thickness was measured by using a laser type film thickness measuring device LT-8000/8010 produced by KEYENCE CORP.

Figure 8:
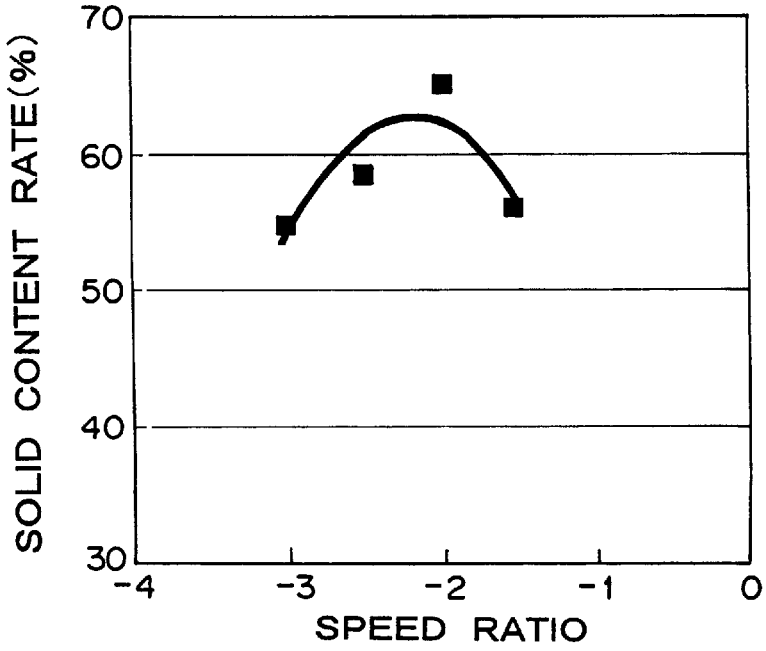
FIG. 8 is a graph showing an experiment result indicating the effect of the squeeze roller speeding ratio of a wet-type developing apparatus according to a fourth embodiment of the present invention.

FIG. 8 shows experiment results when the speed ratio between the squeeze roller and the latent image carrying member under the above state was varied. However, the voltage applied to the squeeze roller was set to 1 KV. As in the case of the first and third embodiments, there was such a tendency that the solid content rate was maximum in some speed ration range. This range of the speed ratio was around −2, and the maximum solid. content rate value was equal to about 65%.

Finally, the liquid developing agent used in the present invention will be described.

Ink material which is film-formed by reducing/removing solvent as disclosed in the specification of U.S. Pat. No. 5,650,253 or U.S. Pat. No. 5,698,616 was used as the liquid developing agent used in these embodiments. The film-formed ink material means liquid developing agent in which minute material having a glass transition point (temperature) lower than the room temperature and fine particles composed of color materials or the like are dispersed in carrier liquid. Usually, they are not mutually brought into contact with each other and cohered. However, when the carrier liquid is removed, only these materials exist and when they are adhered in the form of a film, they are coupled to each other at the room temperature, so that a film is formed. This minute material is obtained by blending ethyl alcohol and methylmethacrylate, and the glass transition temperature thereof may be set by adjusting the blend ratio.

In these embodiments, the material having the glass transition point of −1° C. was used, and NORPAR12 (produced by EXXON Company) was used as the carrier liquid. Further, the present invention may use other liquid developing agent in which particles mainly containing thermally melting and fixing type resin such as polyester and polystyrene are dispersed. Further, in above embodiments the squeeze roller is use as a squeeze member, but a squeeze belt may be used as a squeeze member.

As described above, according to the present invention, the meniscus can be stably formed at the squeeze portion, and the flow-out of toner and toner dispersion can be prevented from occurring even when strong shearing stress is induced in the liquid toner layer under the condition that the carrier liquid is brought into contact with the squeeze roller. Since no flow-out of toner occurs, the solid content amount of the toner remaining in the image area on the latent image carrying member can be prevented from being reduced.

Since the toner is electrically attracted to the latent image carrying member side at the squeeze portion, no squeeze offset occurs and the image concentration is not reduced. Further, the surplus carrier liquid can be efficiently excluded, and a high toner solid content rate can be achieved.

Particularly by using the liquid toner and the squeeze of the present invention, even when another color liquid toner is brought into contact with a toner layer after squeezing, the toner layer does not flow out due to the solvent of the other color liquid toner, and electrification onto the surface of the toner image can be excellently performed, so that two or more color images can be overlaid on the latent image carrying .member without color mixing and image flow-out. Therefore, after the multi-color printing is carried out, these overlaid color toner images can be collectively transferred to an intermediate transfer medium or paper by pressure or the combination of pressure and electric field, so that a multi-color image forming process having improved registration can be provided.

Since this process can form four color developed images through one pass of the latent image carrying medium, and thus there can be provided a high-speed color image forming apparatus. Further, the solid content rate of the toner layer after the squeezing can be enhanced, so that the image quality can be prevented from being degraded due to the transfer and also the drying speed of the toner layer can be enhanced.

What is claimed is:

1. A wet-type developing apparatus in which a latent image carrying member and a squeeze member are moved in the opposite directions to each other without coming into contact with each other and a liquid toner layer on said latent image carrying image member is squeezed between said latent image carrying member and said squeeze member, which comprises:

means for forming the liquid toner layer on said latent image carrying member so that the liquid toner layer in advance of said squeeze member has a thickness smaller than the gap between said latent image carrying member and said squeeze member;

means for making said liquid toner layer penetrate into the gap together with said latent image carrying member; and a power source for forming an electric field between said squeeze member and said latent image carrying member, wherein said liquid toner layer penetrating into the gap between said squeeze member and said latent image carrying member is brought into contact with said squeeze member by an electric attractive force of the electric field generated by said power source to thereby form a desired meniscus.

2. The wet-type developing apparatus as claimed in claim 1, wherein the moving speed ratio of said squeeze member and said latent image carrying member is set within a range of −0.5 to −2.0.

3. The wet-type developing apparatus as claimed in claim 1, wherein the polarity of the potential of said squeeze member is the same as that of the non-image portion of said latent image carrying member, and the absolute value of the potential of said squeeze member is larger than that of the non-image portion of said latent image carrying member.

4. The wet-type developing apparatus as claimed in claim 1, wherein the glass transition point of toner particles dispersed in a carrier liquid of the liquid toner is equal to −1° C. or less.

5. The wet-type developing apparatus as claimed in claims 1, wherein the liquid toner layer at a non-segmented portion on said latent image carrying member after the squeezing has a solid content rate of 55 wt % or more.

6. An image forming apparatus provided with the wet-type developing apparatus as claimed in claims 1, wherein after squeezing, said liquid toner layer is transferred from said latent image carrying member to a recording medium or an intermediate transfer medium by mechanical pressure or both of mechanical pressure and electric field.

7. The image forming apparatus as claimed in claim 6, wherein a process of performing an electrical charging operation on the overall surface of said latent image carrying member having the liquid toner carried thereon, an image exposure operation, a developing operation and a squeezing operation is repeated to form two or more color toner images on said latent image carrying member, and then the two or more color toner images, are collectively transferred onto a transfer medium such as a recording medium, an intermediate transfer medium.

8. A wet-type developing apparatus in which a latent image carrying member and a squeeze member are moved in the opposite directions to each other without coming into contact with each other and a liquid toner layer on said latent image carrying image member is squeezed between said latent image carrying member and-s aid squeeze member, which comprises:

a developing roller and a first power source for generating an electric field to form the liquid toner layer on said latent image carrying member so that said liquid toner layer in advance of said squeeze member has a thickness smaller than the gap between the latent image carrying member and said squeeze member, said developing roller rotating in an opposite direction to a movement direction of said latent image carrying member;

said developing roller rotating in said opposite direction to said movement direction of said latent image carrying member and application of said electric field generated by said first power source making said liquid toner layer penetrate into the gap together with said latent image carrying member; and a second power source for forming an electric field between said squeeze member and said latent image carrying member, wherein said liquid toner layer penetrating into the gap between said squeeze member and said latent image carrying member is brought into contact with said squeeze member by an electric attractive force of the electric field generated by said second power source to thereby form a desired meniscus.

9. A wet-type developing apparatus according to claim 8, wherein said developing roller rotating in said opposite direction to said movement direction of said latent image carrying member and application of said electric field generated by said first power source occur sequentially or simultaneously to make said liquid toner layer penetrate into the gap together with said latent image carrying member.

* * * * *

UNITED STATES PATENT AND TRADEMARK OFFICE

CERTIFICATE OF CORRECTION

PATENT NO. : 6,445,897 B2
DATED : September 3, 2002
INVENTOR(S) : Tsutomu Uezono et al.

It is certified that error appears in the above-identified patent and that said Letters Patent is hereby corrected as shown below:

Title page,
Item [54], please change title to -- WET-TYPE TONER FORMING AND IMAGE FORMING APPARATUS --

Signed and Sealed this

Twelfth Day of November, 2002

*Attest:*

*Attesting Officer*

JAMES E. ROGAN
*Director of the United States Patent and Trademark Office*